US008858118B2

(12) United States Patent
Benton, Jr.

(10) Patent No.: US 8,858,118 B2
(45) Date of Patent: Oct. 14, 2014

(54) EROSION CONTROL MAT SYSTEM

(71) Applicant: Waskey Bridges, Inc., Baton Rouge, LA (US)

(72) Inventor: Stephen G. Benton, Jr., Metairie, LA (US)

(73) Assignee: Waskey Bridges, Inc., Baton Rouge, LA (US)

( * ) Notice: Subject to any disclaimer, the term of this patent is extended or adjusted under 35 U.S.C. 154(b) by 0 days.

(21) Appl. No.: 13/852,158

(22) Filed: Mar. 28, 2013

(65) Prior Publication Data

US 2013/0279983 A1 Oct. 24, 2013

Related U.S. Application Data

(60) Provisional application No. 61/617,509, filed on Mar. 29, 2012, provisional application No. 61/721,337, filed on Nov. 1, 2012.

(51) Int. Cl.
*E02B 3/12* (2006.01)

(52) U.S. Cl.
CPC ..... *E02B 3/123* (2013.01)
USPC ..... 405/20

(58) Field of Classification Search
USPC ..... 405/15–20, 302.4, 302.6; 264/263; 404/34–40
See application file for complete search history.

(56) References Cited

U.S. PATENT DOCUMENTS

| | | | | |
|---|---|---|---|---|
| 3,386,252 | A | 6/1968 | Nelson | |
| 3,597,928 | A | 8/1971 | Pilaar | |
| 4,227,829 | A | 10/1980 | Landry, Jr. | |
| 4,375,928 | A | 3/1983 | Crow | |
| 4,477,206 | A | 10/1984 | Papetti et al. | |
| 4,486,120 | A | 12/1984 | Landry, Jr. | |
| 4,683,156 | A | 7/1987 | Waters | |
| 5,108,222 | A * | 4/1992 | Jansson et al. | 405/20 |
| 5,443,329 | A | 8/1995 | De Getter | |
| 5,484,230 | A * | 1/1996 | Rudloff | 405/20 |
| 5,722,795 | A | 3/1998 | Angel et al. | |
| 5,846,023 | A | 12/1998 | Angel et al. | |
| 5,906,456 | A * | 5/1999 | Knight | 405/20 |
| 5,944,449 | A | 8/1999 | Angel et al. | |
| 6,027,285 | A | 2/2000 | Angel et al. | |
| 6,106,194 | A | 8/2000 | Angel et al. | |
| 6,139,220 | A | 10/2000 | Angel et al. | |
| 6,276,870 | B1 * | 8/2001 | Smith | 405/17 |
| 6,406,217 | B1 | 6/2002 | Daniel et al. | |

(Continued)

*Primary Examiner* — Sunil Singh
(74) *Attorney, Agent, or Firm* — Garvey, Smith, Nehrbass & North, L.L.C.; Charles C. Garvey, Jr.; Vanessa M. D'Souza

(57) ABSTRACT

An erosion control mat provides a plurality of concrete blocks. Each block has an upper portion and a lower portion, each with a plurality of side walls. The block has an upper surface and a lower surface and a block periphery in the form of an edge. Cables or ropes connect the blocks together to form a block matrix. Each block has a boot with a plurality of inclined side panels affixed to the block lower portion. The boot has a lower panel, a boot interior that is receptive of at least part of the block lower portion. A plurality of anchor posts are attached to the boot interior surface. Some of the anchor posts are attached to the boot side wall panels and lower panel to enable a connection to be formed between the boot and the block inclined lower side walls and lower surface.

20 Claims, 12 Drawing Sheets

(56) References Cited

U.S. PATENT DOCUMENTS

| | | | | |
|---|---|---|---|---|
| 6,416,253 | B1 * | 7/2002 | Wimp et al. | 405/172 |
| 6,508,607 | B1 * | 1/2003 | Smith et al. | 405/20 |
| 6,558,074 | B2 * | 5/2003 | Jansson | 405/16 |
| 6,579,038 | B1 * | 6/2003 | McAllister et al. | 405/16 |
| 6,688,810 | B2 * | 2/2004 | Jansson | 405/18 |
| 6,739,797 | B1 * | 5/2004 | Schneider | 404/35 |
| 6,866,446 | B2 * | 3/2005 | McAllister et al. | 405/16 |
| 6,955,500 | B1 * | 10/2005 | Smith et al. | 405/20 |
| 7,037,037 | B1 * | 5/2006 | Smith et al. | 405/20 |
| 7,918,623 | B2 * | 4/2011 | Lacroix et al. | 404/35 |
| 8,678,705 | B1 * | 3/2014 | Smith et al. | 405/20 |
| 2010/0104379 | A1 * | 4/2010 | Amuchastegui et al. | 405/302.6 |

* cited by examiner

EROSION CONTROL MAT SYSTEM

CROSS-REFERENCE TO RELATED APPLICATIONS

This is a non provisional patent application of US Provisional Patent Application Ser. No. 61/617,509, filed 29 Mar. 2012; and U.S. Provisional Patent Application Ser. No. 61/721,337, filed 1 Nov. 2012.

Priority of U.S. Provisional Patent Application Ser. No. 61/617,509, filed 29 Mar. 2012; and U.S. Provisional Patent Application Ser. No. 61/721,337, filed 1 Nov. 2012, each of which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to mats used for erosion control, pipeline protection, crossings, and many other subsea uses, and methods of installing such mats. More particularly, the present invention relates to an improved mat and method of manufacture wherein a specially configured mould provides concave and convex sides, the concave side providing a plurality of inclined surfaces, each having one or more anchors and wherein the convex side provides hemispherically shaped projections which extend over a bottom surface of the mould, the mould being configured to accept a cementitious fill for forming an block and wherein the blocks can be connected with cables or ropes to form a mat.

2. General Background of the Invention

Erosion control mats have been used for many years to protect soil surfaces such as the banks of water bodies (lakes, rivers, etc.).

Another example of an erosion control mat is the Pilaar (U.S. Pat. No. 3,597,928). The Pilaar patent relates to an erosion controlling protective surface for a soil mass. The device includes a flexible supporting sheet that can conform to the contour of the soil and blocks that are mounted on the supporting sheet. The mat provides drainage passageways therethrough so that water can pass through the surfacing. Preferably, the surfacing includes a filter and the blocks are secured with the supporting sheet.

The Nelson (U.S. Pat. No. 3,386,252) shows a rip rap structure that employs concrete blocks connected together.

Cables are employed to hold blocks together in the Landry (U.S. Pat. No. 4,227,829) to form a matrix.

The Crow (U.S. Pat. No. 4,375,928) shows rows of blocks held together by a continuous wire cable which is embedded in each block.

The Waters (U.S. Pat. No. 4,683,156) shows an erosion control blanket of segments. The segments are said to be of concrete placed into shells. The segments are held together with a rope network. Openings in the shells provide points of entry for the ropes.

The Rudloff (U.S. Pat. No. 5,484,230) provides a concrete block revetment system for soil erosion prevention. The system of the Rudloff patent provides concrete blocks that are cable interconnected to form a matrix. The matrix of blocks overlies and holds in place a layer of permeable geotextile overlying a protected soil area.

The Angel (U.S. Pat. No. 6,027,285) entitled "Mat Installation" shows cable connected erosion control blocks that can be used over pipe lines. Other patents issued to Angel include U.S. Pat. Nos. 5,722,795; 5,846,023; and 5,944,449.

The Landry (U.S. Pat. No. 4,486,120) provides a spreader bar for the installation of soil erosion prevention mats.

The Daniel (U.S. Pat. No. 6,406,217) provides a lifting and placing device for seabed mats.

Other patents possibly relevant to the construction and use of mats for erosion control, pipeline protection, crossings, and many other subsea uses can be seen in the following table, the listing being chronological and otherwise of no significance. Each of the patents listed in the table is hereby incorporated herein by reference.

The following US Patents are incorporated herein by reference:

| Pat. No. | Title | Issue Date MM/DD/YYYY |
|---|---|---|
| 3,386,252 | Rip Rap Structure Device | Sep. 08, 1966 |
| 3,597,928 | Erosion Control | Aug. 10, 1971 |
| 4,227,829 | Soil Erosion Preventing Blocks | Oct. 14, 1980 |
| 4,375,928 | Flexible Concrete For Soil Erosion Prevention | Mar. 08, 1983 |
| 4,486,120 | Spreader Bar For Soil Erosion Prevention Mats | Dec. 04, 1984 |
| 4,683,156 | Flexible Blanket | Jul. 28, 1987 |
| 5,484,230 | Concrete Block Revetment System For Soil Erosion Prevention | Jan. 16, 1996 |
| 5,722,795 | Non-Abrasive Subsea Mat | Mar. 03, 1998 |
| 5,846,023 | Non-Abrasive Subsea Mat | Dec. 08, 1998 |
| 5,944,449 | Non-Abrasive Subsea Mat | Aug. 31, 1999 |
| 6,027,285 | Mat Installation | Feb. 22, 2000 |
| 6,406,217 | Lifting and Placing Device for Seabed Mats | Jun. 18, 2002 |

BRIEF SUMMARY OF THE INVENTION

The present invention provides an improved mat used for erosion control, pipeline protection, crossings, and many other subsea uses, that utilizes a plurality of concrete blocks, each block having an upper portion with a plurality of inclined side walls and a lower portion with a plurality of inclined lower side walls. The block provides an upper surface and a lower surface and a block periphery in the form of a block edge where the upper and lower side walls meet.

Cables or ropes, more specifically copolymer rope, connect the blocks together to form a matrix. The cables or ropes can include multiple cables or ropes or one continuous cable/rope that is looped from one row of blocks or one column of blocks to the next column of blocks.

Each block has a boot affixed to the block lower portion. The boot has a plurality of inclined side panels, each side panel having an upper edge. The boot has a lower panel and an interior surface. The boot has an interior that is receptive of at least part of the block lower portion.

The boot inclined side panels engage the block inclined lower side walls. The boot lower panel engages the block lower surface.

The boot has a plurality of anchor posts attached to the interior surface of the boot. These anchor posts include some anchor posts attached to the side wall panels of the boot. These first plurality of anchor posts enable a connection to be formed between one or more of the boot inclined side panels and the lower side walls of the block.

Some of the anchor posts are attached to the boot lower panel. This second plurality of anchor posts enable a connection to be formed between the boot lower panel and the block lower surface.

This improved boot arrangement solves the problem of peeling that can occur during deployment of the mats because they are often lowered to a pipeline resting on a seabed. Mechanical interaction between the mat and the pipeline can dislodge the boots which results in end complete protection for the pipeline.

In one embodiment, a plurality of the anchor posts have central longitudinal axes that are parallel.

In one embodiment, the boot lower panel has a plurality of projections. In one embodiment, the projections are hemispherically shaped.

In one embodiment, there is a concavity on the interior surface of the boot bottom panel next to each projection. In this fashion, when the boot is placed in a mould and slurried concrete added to the mould, the slurry concrete not only fills the interior of the boot but also the concavities behind each projection, thus further reinforcing the projections during use.

In one embodiment, at least some of the boot side panels have two or more anchor posts. In another embodiment, each side panel has two or more anchor posts.

In one embodiment, the anchor posts do not extend beyond the upper edges of the boot.

In one embodiment, the boot side wall upper edges do not extend above the block edge.

In one embodiment, the boot upper edges are positioned below the cables/ropes.

The present invention provides a method of constructing a mat. The method includes the providing of a mould apparatus that includes multiple moulds.

A boot is placed in each mould. Each boot has a plurality of boot anchor posts, a plurality of inclined side panels, each side panel having an upper edge, the boot having a lower panel, a boot interior surface and a boot interior or cavity that is receptive of slurried concrete that can be added to the mould interior after the boot is placed in the mould interior.

In a preferred embodiment, the exterior surface of the boot and the interior surface of the mould are correspondingly shaped at least in the lower half of the mould.

As part of the method, the mould is filled with slurried concrete after the boot is placed in the mould. The slurried concrete sets after a time period to form a plurality of concrete blocks. Each block has an upper portion with a plurality of inclined side walls and a lower portion with a plurality of inclined lower side walls. The block has an upper surface, a lower surface and a block periphery in the form of a block edge where the upper and lower block side walls meet.

Before the time period expires, one or more cables/ropes are placed into the moulds so that after the time period expires, the cable/rope or cables/ropes connect the blocks together to form a block matrix which forms a mat.

A connection is formed of the boot to the slurried concrete before the time period expires using a plurality of anchor posts extending from the boot to the slurried concrete.

The plurality of anchor posts are attached to the interior surface of the boot. Some of the anchor posts are attached to side wall panels to enable a connection to be formed between the boot inclined side panels and the block inclined lower side walls.

Some of the anchor posts are attached to the lower panel to enable a connection to be formed between the boot lower panel and the block lower surface. In a preferred method, the boot lower panel has a plurality of projections.

In one embodiment, there is a concavity on the interior surface of the boot bottom panel at each projection. This concavity is filled with slurried concrete as part of the method.

An erosion control mat provides a plurality of concrete blocks. Each block has an upper portion with a plurality of upper inclined side walls. Each block has a lower portion with a plurality of inclined lower side walls. The block has an upper surface and a lower surface and a block periphery in the form of an edge where the upper and lower side walls meet. Cables or ropes connect the blocks together to form a block matrix and the erosion control mat. Each block has a boot affixed to the block lower portion, the boot having a plurality of inclined side panels. Each boot side panel has an upper edge. The boot has a lower panel, a boot interior surface and an interior that is receptive of at least part of the block lower portion. The boot inclined side panels engage the block inclined lower side walls. The boot lower panel engages the block lower surface. A plurality of anchor posts are attached to the interior surface of the boot. Some of the anchor posts are attached to the side wall panels to enable a connection to be formed between the boot inclined side panels and the block inclined lower side walls. Some of the anchor posts are attached to the lower panel of the boot to enable a connection to be formed between the boot lower panel and the block lower surface. As part of the method, the boot is first placed in a mould. Slurried concrete is then added to the mould so that a connection is formed between the boot anchor posts and the concrete when the concrete sets after a time period.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 17:
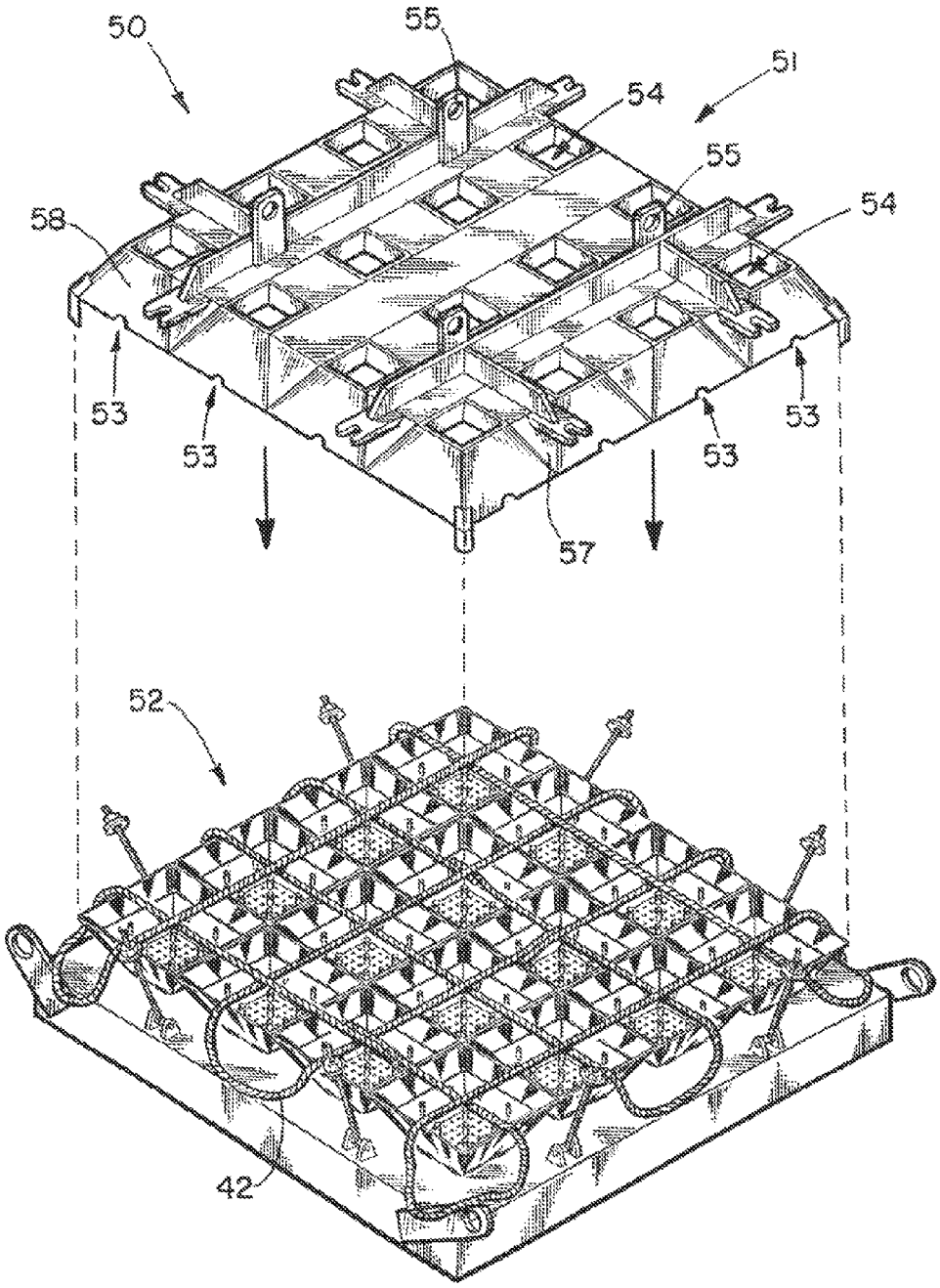
FIG. 17 is a fragmentary perspective view of a preferred embodiment of the apparatus of the present invention showing the mould.
Figure 20:
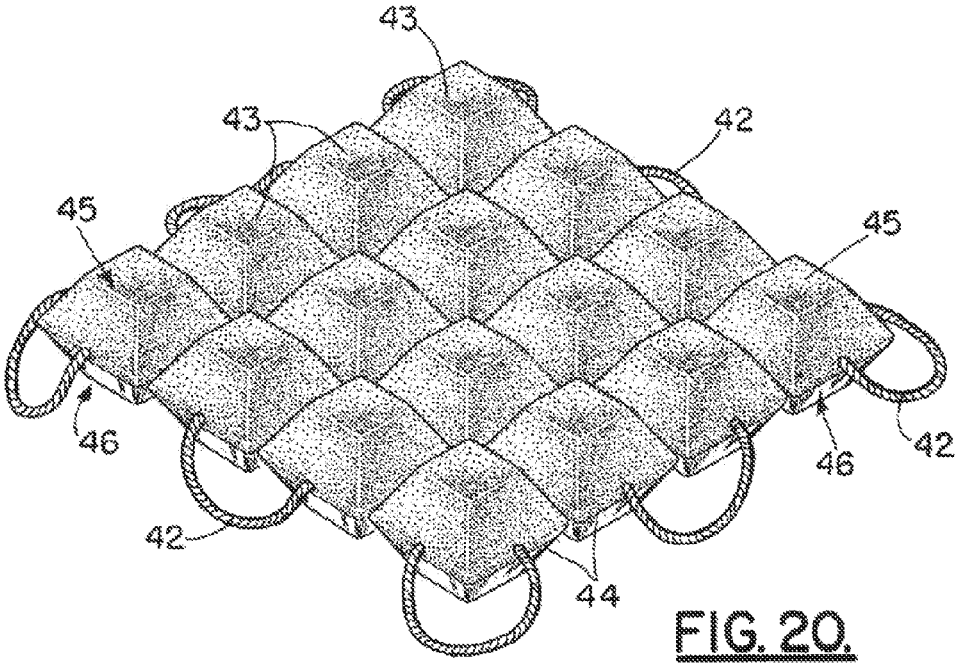
FIG. 20 is a perspective view of a preferred embodiment of the apparatus of the present invention showing blocks and interconnecting ropes.
Figure 21:
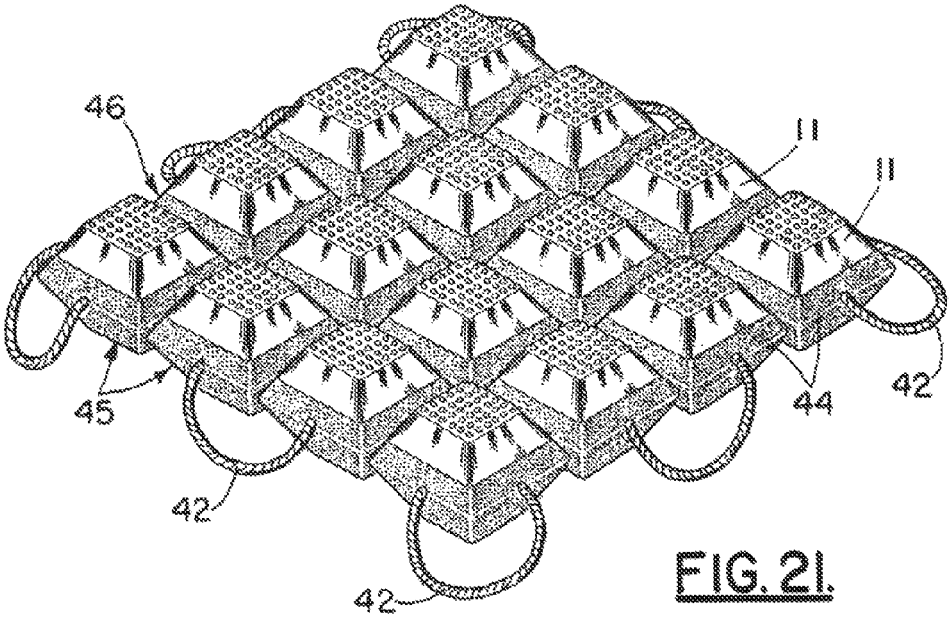
FIG. 21 is a perspective view of a preferred embodiment of the apparatus of the present invention showing blocks and interconnecting ropes.

FIGS. 1-7 show a preferred embodiment of the apparatus of the present invention which is designated generally by the numeral 10. Mat apparatus 10 employs a boot 11 which can be placed in a mould 50 prior to the addition of a wet or slurried concrete mix. Once the concrete mix cures or sets, blocks are formed. The mould 50 provides halves 51, 52 and rope or cable 42 openings 53. The openings 53 enable rope or cable, such as copolymer rope, wire rope or any other selected connecting rope or cable, to be used to connect the concrete or cast blocks 43. The blocks 43 are preferably of concrete material which is initially a slurry added to the moulds 50 and allowed to set with the connecting rope 42 in place (see FIG. 18). After the concrete sets, an erosion control mat 10 is formed of individual blocks 43 connected by rope 42 (see FIGS. 19-21). The boot 11 is a liner that is placed in the mould 50 lower half 52. Boot 11 then becomes a covering, coating or boot for a lower part of the block 43 after the concrete or cementitious filler material hardens or sets. As seen in FIG. 17, the rope or cable 42 runs through each block 43 in two directions, each such rope or cable perpendicular to the other within a given block 43. Mould 50 can include multiple mould cavities 58, one cavity forming one block 43. An upper opening 54 enables intake of slurried or wet concrete. Rope or cable 42 can be of any material such as wire rope, polymeric rope, copolymer rope, or any other elongated tensile material.

Figure 1:
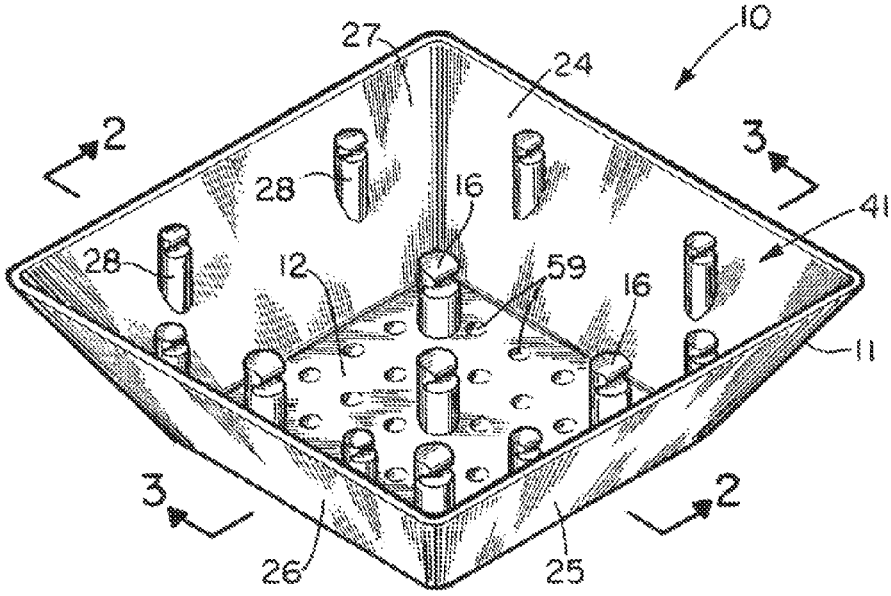
FIG. 1 is a perspective view of a preferred embodiment of the apparatus of the present invention.
Figure 2:
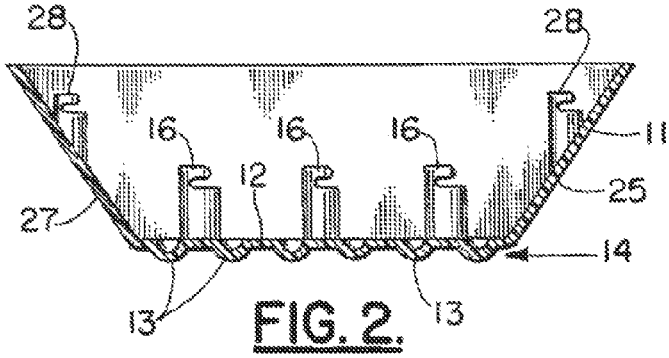
FIG. 2 is a side sectional view of a preferred embodiment of the apparatus of the present invention taken along lines 2-2 of FIG. 1.
Figure 3:
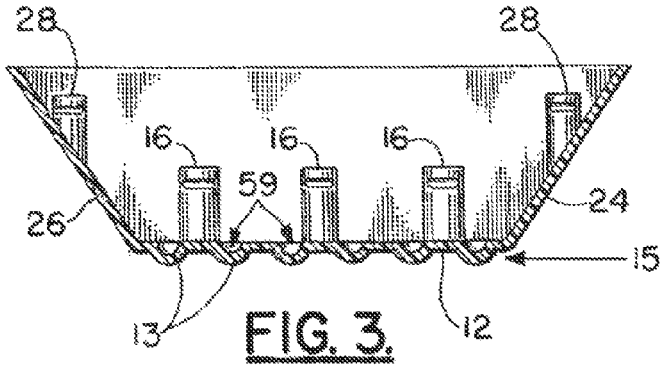
FIG. 3 is a side sectional view of a preferred embodiment of the apparatus of the present invention taken along lines 3-3 of FIG. 1.
Figure 4:
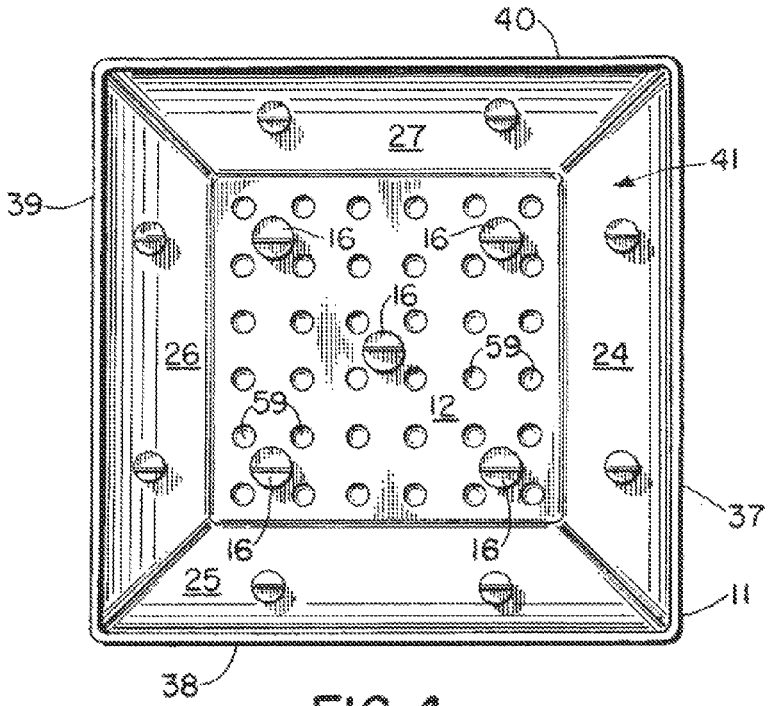
FIG. 4 is a top view of a preferred embodiment of the apparatus of the present invention.
Figure 5:
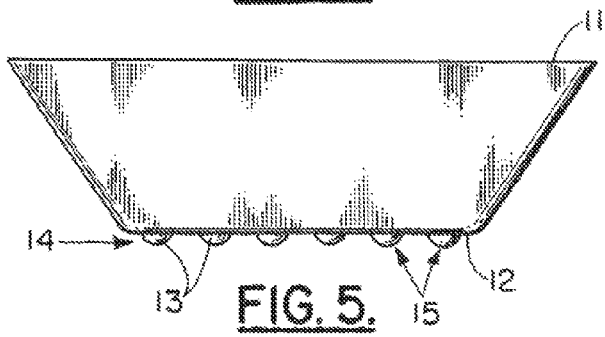
FIG. 5 is a side view of a preferred embodiment of the apparatus of the present invention.

In FIGS. 1-5, the boot 11 has a panel 12 which can be characterized as a bottom panel. The boot 11 can be about 9 15/16"-10⅛" (25.2 cm-25.7 cm) long, about 9 15/16"-10⅛" (25.2 cm-25.7 cm) wide, and about 3" (7.6 cm) high. Panel 12 can be about 6¼" (15.9 cm) wide and about 6¼" (15.9 cm) long. The under surface of the panel 12 is provided with a plurality of projections 13 that are arranged in an array. The projections 13 can be hemispherically shaped projections as seen in FIGS. 2-3, 5. The array of projections or hemispherical projections 13 can thus include a plurality of rows 14 of projections 13 and a plurality of columns 15 of projections. In FIGS. 1-5, there can be seen six rows 14 of projections and six columns 15 of projections to form the array of projections 13. Projections 13 can be located about 1" (2.5 cm) apart from each other on panel 12. The projections 13 located closest to the edges of panel 12 can be located about ⅝" (1.6 cm) from the edge of panel 12. Projections 13 can extend about ¼" (0.6 cm) from the under surface of panel 12 and can be about ½" (1.3 cm) wide. The boot 11 includes a plurality of inclined side walls 24, 25, 26, 27. As shown in FIGS. 1-5, each inclined side wall 24, 25, 26, 27 is joined to panel 12 and to other side walls. The combination of bottom panel 12 and inclined side panels, 24, 25, 26, 27 can be a one piece plastic boot 11 such as an injection moulded integral part.

A plurality of generally cylindrically shaped posts or anchors 16 are attached to the inside surface of panel 12 as seen in FIGS. 1-4. Each of the posts or anchors 16 (see FIG. 7) can provide a generally cylindrically shaped side wall 17 (about 1¼" (3.2 cm) long), an upper end portion 22 (about ⅜" (1.0 cm) wide) and a lower end portion 23 (about 1 1/16" (2.7 cm) wide). The lower end portion 23 can be flat and circular where the anchor or post 16 is joined to panel 12. The upper end portion 22 of each post 16 can provide recess or concavity 18, a projecting portion 19, and curved surfaces at 20 (having a radius of curvature of ⅛" (0.3 cm)), 21 (having a radius of curvature of ¼" (0.6 cm)).

Figure 6:
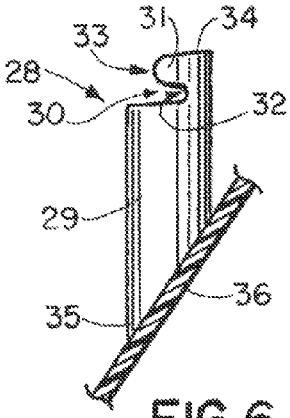
FIG. 6 is a fragmentary side elevation view of a preferred embodiment of the apparatus of the present invention.

FIG. 6 shows a post or anchor 28. A post or anchor 28 is attached to an inclined side wall or panel 24, 25, 26, 27. In a preferred embodiment, multiple of the panels 24, 25, 26, 27 have posts 28. Each post 28 has a generally cylindrically shaped side wall portion 29, a diagonally extending or inclined surface 36, and end portions 34, 35. The end portion 35 provides the diagonally extending or inclined surface 36. Post or anchor 28 can be about ½" (1.3 cm) wide. End portion 34 can be about ¼" (0.6 cm) wide.

Figure 7:
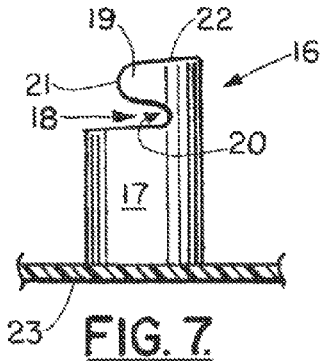
FIG. 7 is a fragmentary side elevation view of a preferred embodiment of the apparatus of the present invention.

As with the post 16, the post 28 provides end portion 34 having a recess or concavity 30, projecting portion 31, and curved surfaces at 32 (having a radius of curvature of 1/16" (0.2 cm)), 33 (having a radius of curvature of 3/16" (0.5 cm)). In the embodiment shown, each of the posts 16 has a central longitudinal axis that forms a right angle or 90 degrees with the panel 12 as shown in FIGS. 4, 7. The central longitudinal axes of the posts 16, 28 can be parallel.

In the embodiment shown in FIGS. 1 and 4, the panel 12 provides five posts 16. Each of the inclined side walls or panels 24, 25, 26, 27 provides a pair of posts 28. Each post or anchor 28 has a central longitudinal axis that forms an acute or obtuse angle with the panel 24, 25, 26, 27 to which it is attached. Post 28 can be about ½" (1.3 cm) diameter and about 1 11/16" (4.3 cm) long. Post 16 can be about ¾" (1.9 cm) in diameter and about 1¼" (3.2 cm) long.

Each inclined side wall or panel 24, 25, 26, 27 provides an upper edge which defines the top of the boot 11. These edges can be seen in FIG. 4 as edges 37, 38, 39, 40. Edges 37, 38, 39, 40 can be about 9 15/16"-10⅛" (25.2 cm-25.7 cm) long. In a preferred embodiment, the top of each post or anchor 16, 28 is at or below edges 37, 38, 39, 40. The boot 11 provides a cavity 41 that is receptive of wet or slurried concrete or other suitable filler material which fills the mould 50 cavity 58 in order to form a final block 43 of the erosion control mat 10.

Figure 16:
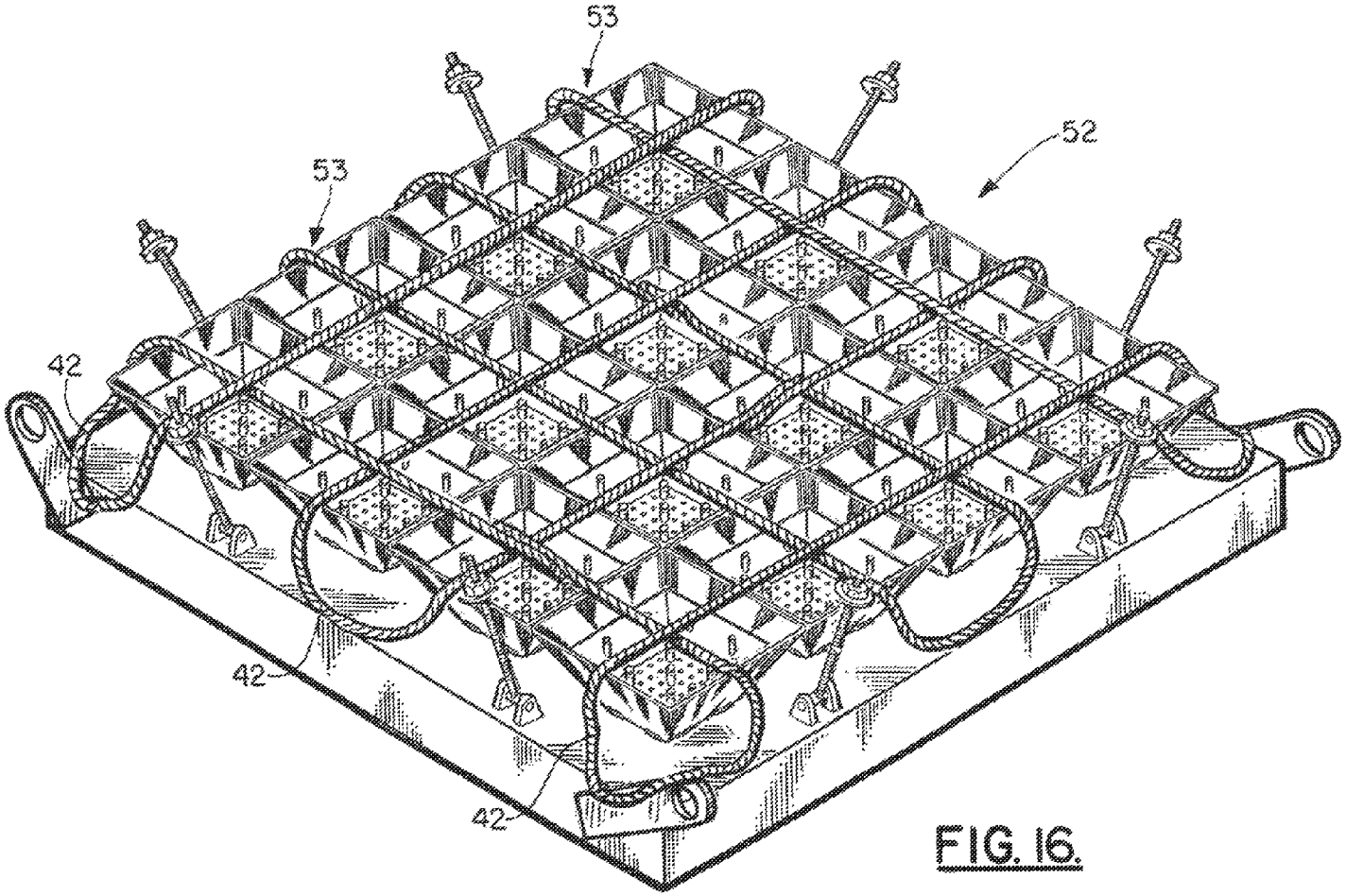
FIG. 16 is a fragmentary perspective view of a preferred embodiment of the apparatus of the present invention showing the mould.
Figure 18:
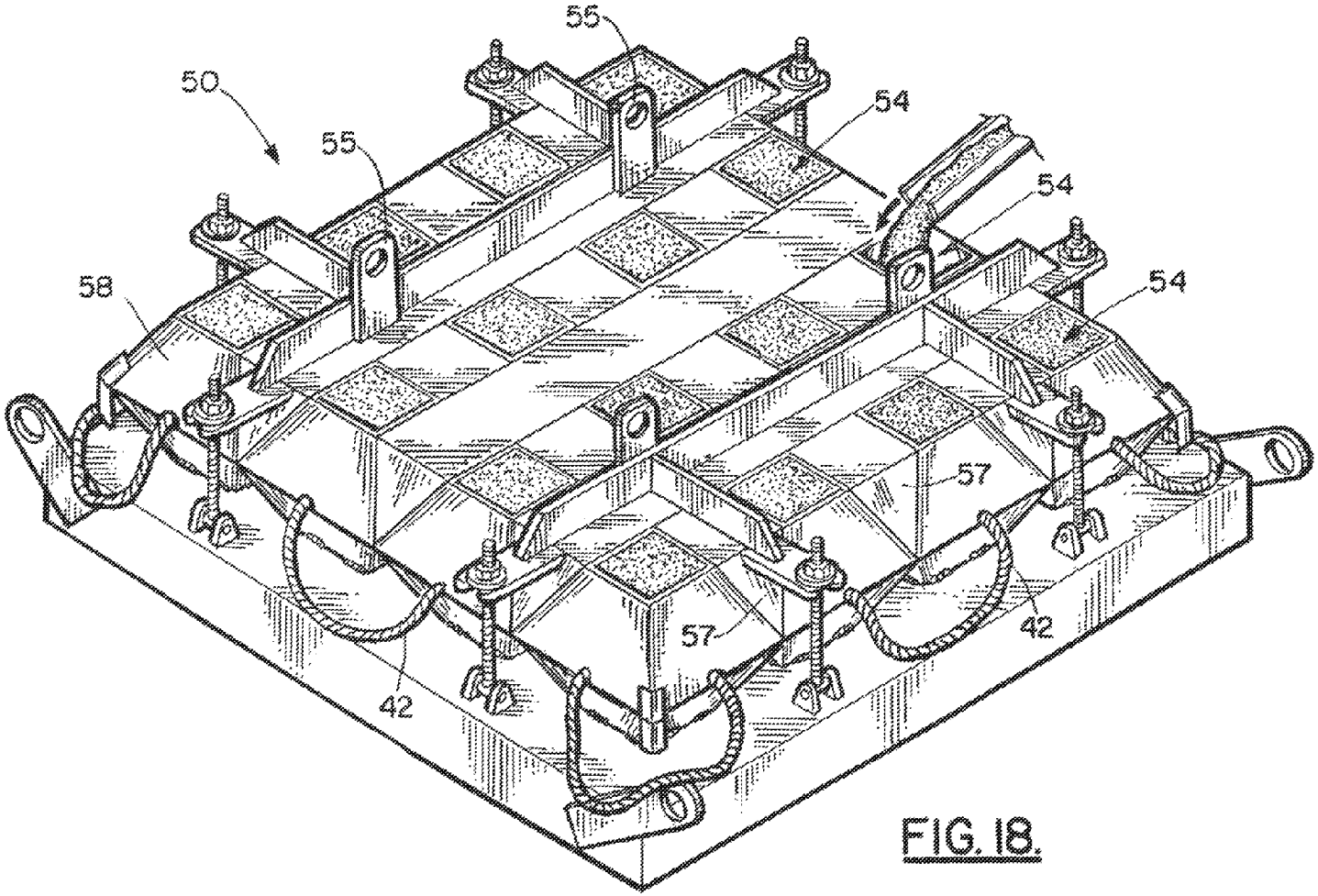
FIG. 18 is a fragmentary perspective view of a preferred embodiment of the apparatus of the present invention showing the mould.
Figure 19:
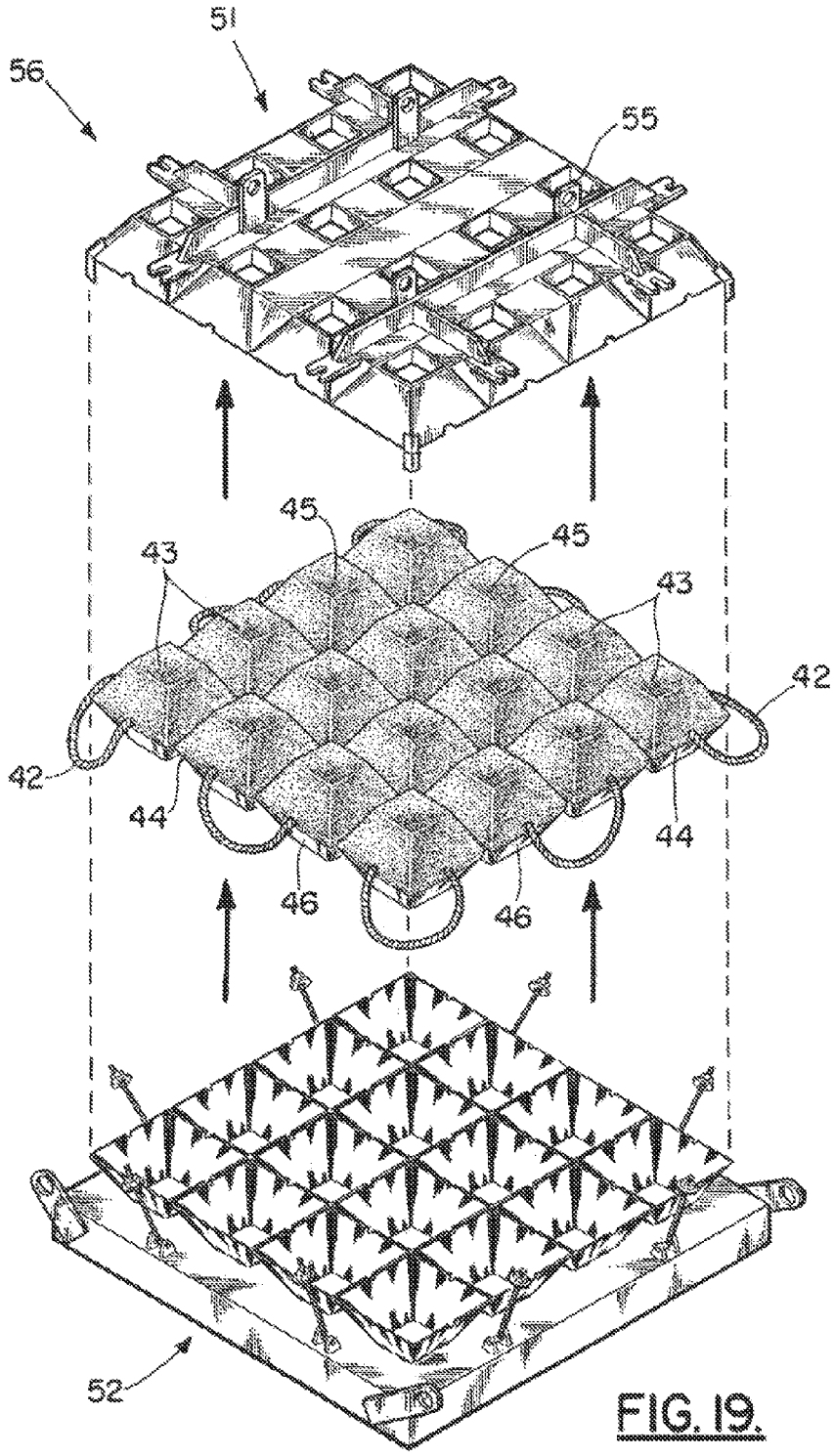
FIG. 19 is a perspective view of a preferred embodiment of the apparatus of the present invention showing blocks and interconnecting ropes.

In FIGS. 14-19, the mould or moulds 50 can be shown in more detail. Padeyes 55 can be used to lift and transport the moulds 50. Each mould 50 can provide an upper mould half 51 and a lower mould half 52. Mould halves 51, 52 each provide semi-circular openings so that when the two mould halves 51, 52 are assembled, a rope opening 53 is provided. Preferably, there are four rope openings 53 spaced equal distance around the periphery of the mould 50 cavity 58 as shown. In FIGS. 16-18, the rope or other cable 42 can be shown inserted through the rope openings 53 and interconnecting the blocks 43. Once the moulds 51, 52 are filled with concrete in its slurried or wet form the ropes 42 are encapsulated with concrete. Connecting members 57 can be used to help keep the moulds 50 at the correct spacing. Each mould 50 thus provides a mould cavity 58 which defines the overall shape of each block 42, that final block 42 shape seen in FIGS. 19-21. FIGS. 17-19 show the mould cavities 58 and the multiple cavity mould assembly 56. Each block 43 has a periphery 44 and an upper block section 45 and lower block section 46. The boot 11 would thus be placed in the mould 50 lower half 52 before slurried concrete in its wet form is added to the mould 50 via upper opening concrete inlet 54. The concrete not only fills the mould cavity 58 but also fills the cavity 41 of the boot 11. Hemispherically shaped concavities 59 can be provided, one for each projection or hemispherical projection 13. These hemispherically shaped concavities 59 would also be filled with concrete when the liquid or slurried concrete mix is added to the mould 50 interior or cavity 58. The entire boot 11 including panel 12, panels 24, 25, 26, 27, post 16, posts or anchors 28, and projecting hemispherical projections 13 can be a one piece injection moulded member.

Figure 8:
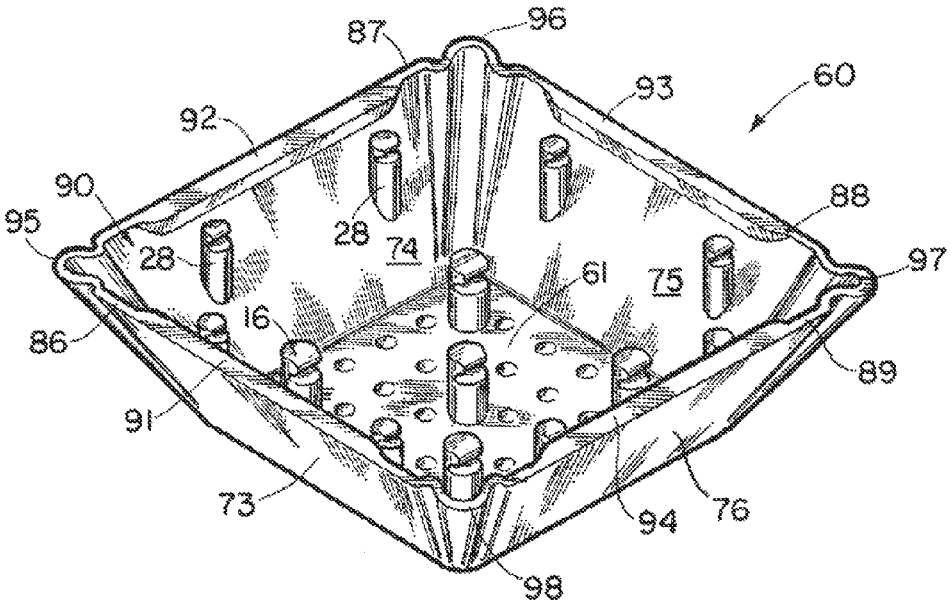
FIG. 8 is a perspective view of another embodiment of the apparatus of the present invention.
Figure 9:
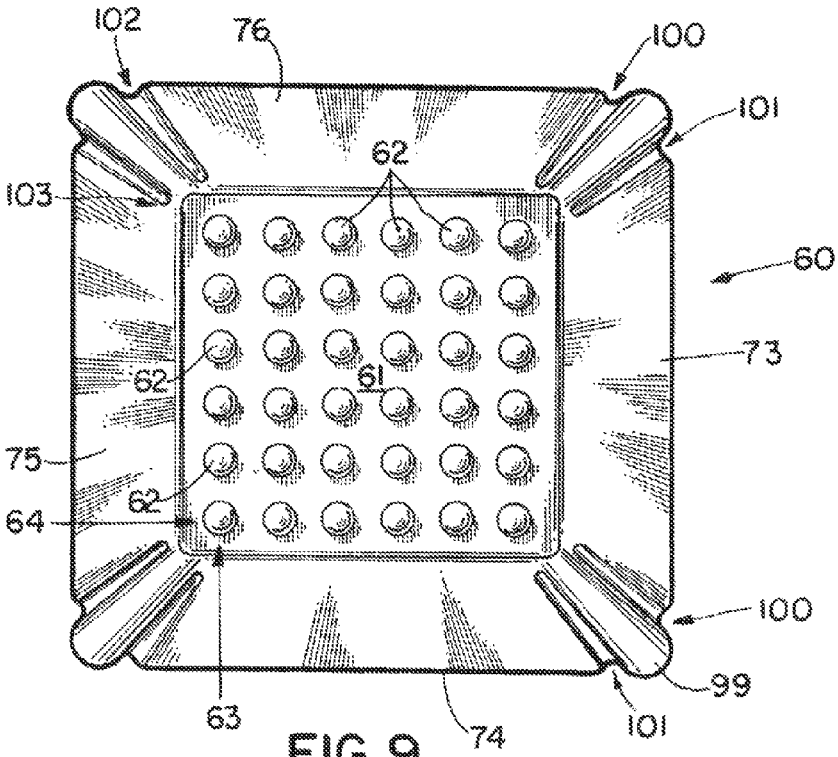
FIG. 9 is a bottom view of the embodiment of FIG. 8.

Another or alternate boot is shown in FIGS. 8-9, designated by the numeral 60. The boot 60 can be about 9 15/16"-10⅛" (25.2 cm-25.7 cm) long, about 9 15/16"-10⅛" (25.2 cm-25.7 cm) wide, and about 3" (7.6 cm) high. In FIGS. 8-9, the boot 60 has a panel 61 which can be characterized as a bottom wall or panel. Panel 61 can be about 6¼" (15.9 cm) wide and about 6¼" (15.9 cm) long. The under surface of the panel 61 is provided with a plurality of projections 62 that are arranged in an array (see FIGS. 8-9). The projections 62 can be hemispherically shaped projections as seen in FIG. 9. The array of projections or hemispherical projections 62 can thus include a plurality of rows 63 of projections 62 and a plurality of columns 64 of projections 62. In FIGS. 8-9, there can be seen six rows 63 of projections and six columns 64 of projections to form the array of projections 62. Projections 62 can be located about 1" (2.5 cm) apart from each other on panel 61. Projections 62 can extend about ¼" (0.6 cm) from the under surface of panel 61 and can be about ½" (1.3 cm) wide.

The boot 60 includes a plurality of inclined side walls 73-76. As shown in FIGS. 8-9, each inclined side wall 73-76 is joined to panel 61 and to other side walls. The combination of bottom panel 61 and inclined side panels 73-76 can be a one piece plastic boot 60 such as an injection moulded integral part.

A plurality of generally cylindrically shaped posts or anchors 16 are attached to the inside surface of panel 61 as seen in FIG. 8. Posts or anchors 16 attached to boot 60 can be configured as seen in FIG. 7. One or more posts or anchors 28 are attached to an inclined side wall or panel 73-76. Posts or anchors 28 attached to boot 60 can be configured as seen in FIG. 6. In a preferred embodiment, multiple of the panels 73-76 have posts 28.

In the embodiment shown in FIGS. 8-9, each of the posts 16 has a central longitudinal axis that forms a right angle or 90 degrees with the panel 61. The central longitudinal axes of the posts 16, 28 can be parallel.

In the embodiment shown in FIGS. 8-9, the panel 61 provides five posts 16. Each of the inclined side walls or panels 73-76 provides a pair of posts 28 as seen in FIG. 8. Each post or anchor 28 has a central longitudinal axis that forms an acute or obtuse angle with the panel 73-76 to which it is attached. Posts 16 in FIGS. 8-9 can be about ¾" (1.9 cm) in diameter and about 1¼" (3.2 cm) long. Posts 28 in FIGS. 8-9 can be about ½" (1.3 cm) in diameter and about 1 5/16" (3.3 cm) long.

Each inclined side wall or panel 73-76 provides an upper edge which defines the top of the boot 60. These edges 86-89 can be seen in FIG. 8 as edges 86-89. In a preferred embodiment, the top of each post or anchor 16, 28 is at or below edges 86-89. The boot 60 provides a cavity 90 that is receptive of wet or slurried concrete or other suitable filler material which fills the mould 50 cavity 58 and cavity 90 in order to form a final block 43 of the mat 10. Each mould cavity 58 is thus fitted with a boot 60 before slurried concrete is added.

In FIGS. 8 and 9, there are provided a plurality of projecting lips that project inwardly of the upper edges 86-89 of the inclined side walls 73-76. The inwardly extending lips 91-94 are spaced from the recesses, concavities or corrugations 100, 101 that are on opposing sides of each corner 95, 96, 97, 98. Each corner 95-98 includes a curved side wall 99 that is in between two recesses, concavities or corrugations 100, 101. As seen in FIGS. 8 and 9, each of the recesses, concavities or corrugations 100, 101 has a larger upper end portion 102 and a smaller lower end portion 103. The cross section of each recess or concavity 100, 101 gradually decreases between the upper end portion 102 and the lower end portion 103 as shown in FIGS. 8 and 9.

The inwardly projecting lips 91-94 help to sturdy or rigidify the side walls 73-76, preventing them from flexing. If the side walls 73-76 flex inward, concrete can easily flow over the side of the boot 60 and compromise the protection that the boot provides.

The corners 95-98 are provided with the recesses at 100, 101 to allow the side walls 73-76 to flex in and out. The design of each of the corners 95-98 with recesses 100, 101 provide some flexibility to the side walls if the height of the individual block 43 changes such as for example, from 9" to 12" (22.9 cm to 30.5 cm). Thus, the angle assumed by each of the outer walls to change as the height of the block 43 changes. The "fluted" corners provide this flexibility.

Figure 10:
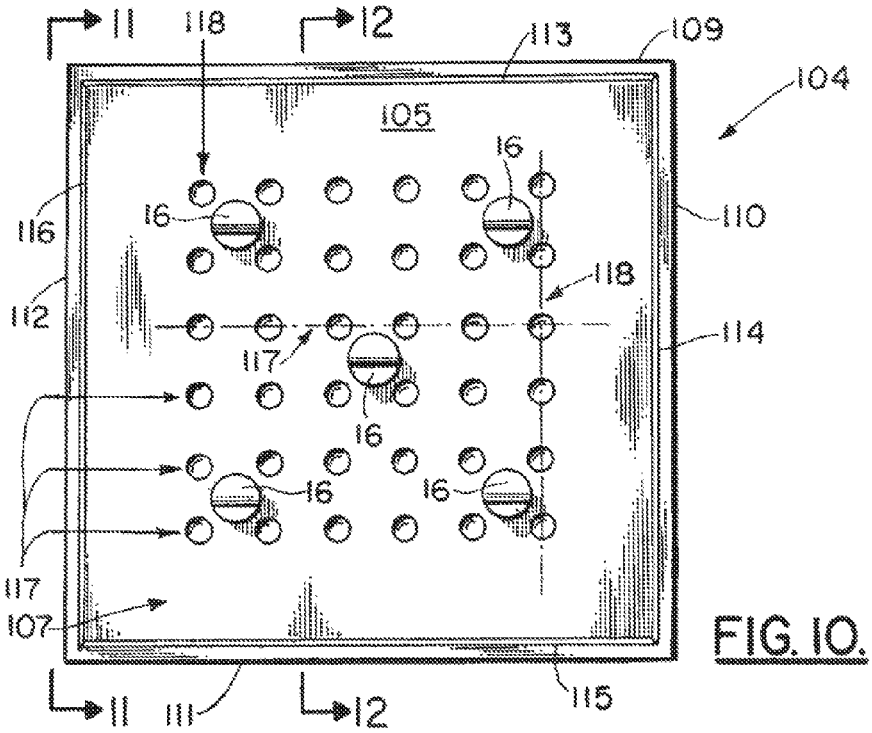
FIG. 10 is a top view of an alternate embodiment of the apparatus of the present invention.
Figure 11:
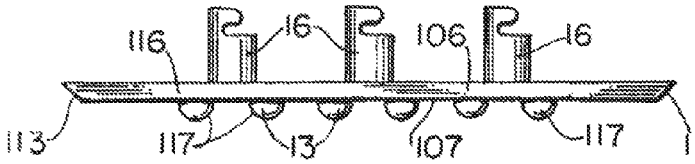
FIG. 11 is a side view of an alternate embodiment of the apparatus of the present invention taken along lines 11-11 of FIG. 10.
Figure 12:
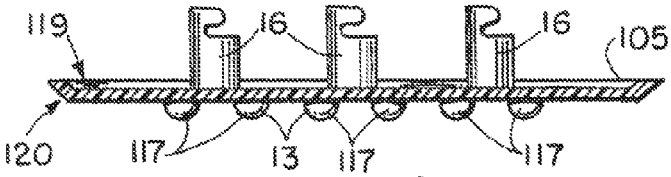
FIG. 12 is a side sectional view of an alternate embodiment of the apparatus of the present invention taken along lines 12-12 of FIG. 10.
Figure 13:
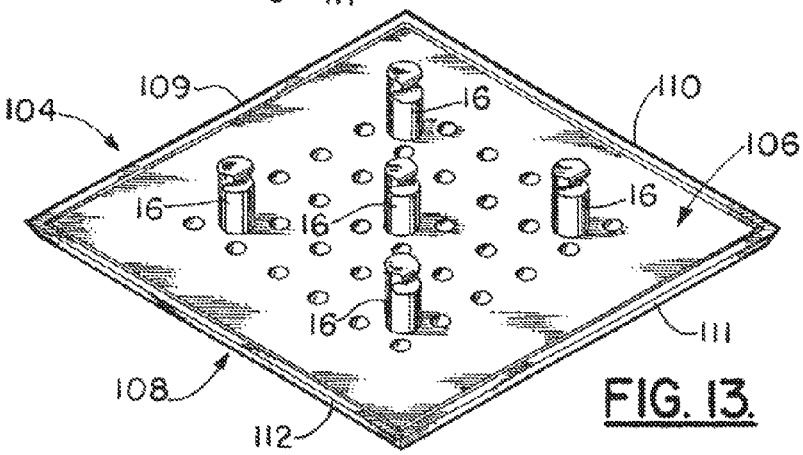
FIG. 13 is a perspective top view of an alternate embodiment of the apparatus of the present invention.
Figure 14:
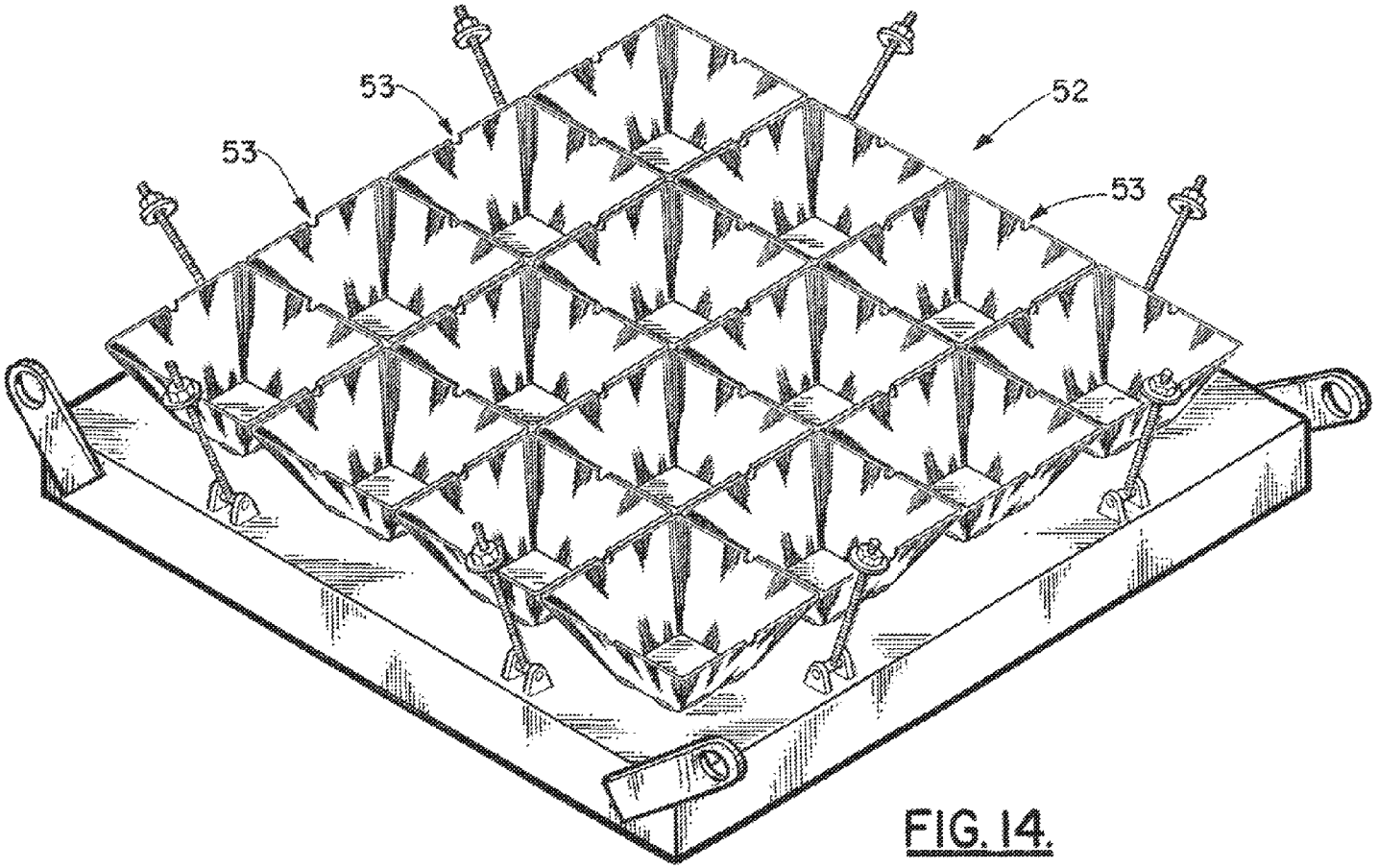
FIG. 14 is a fragmentary perspective view of a preferred embodiment of the apparatus of the present invention showing the mould.
Figure 15:
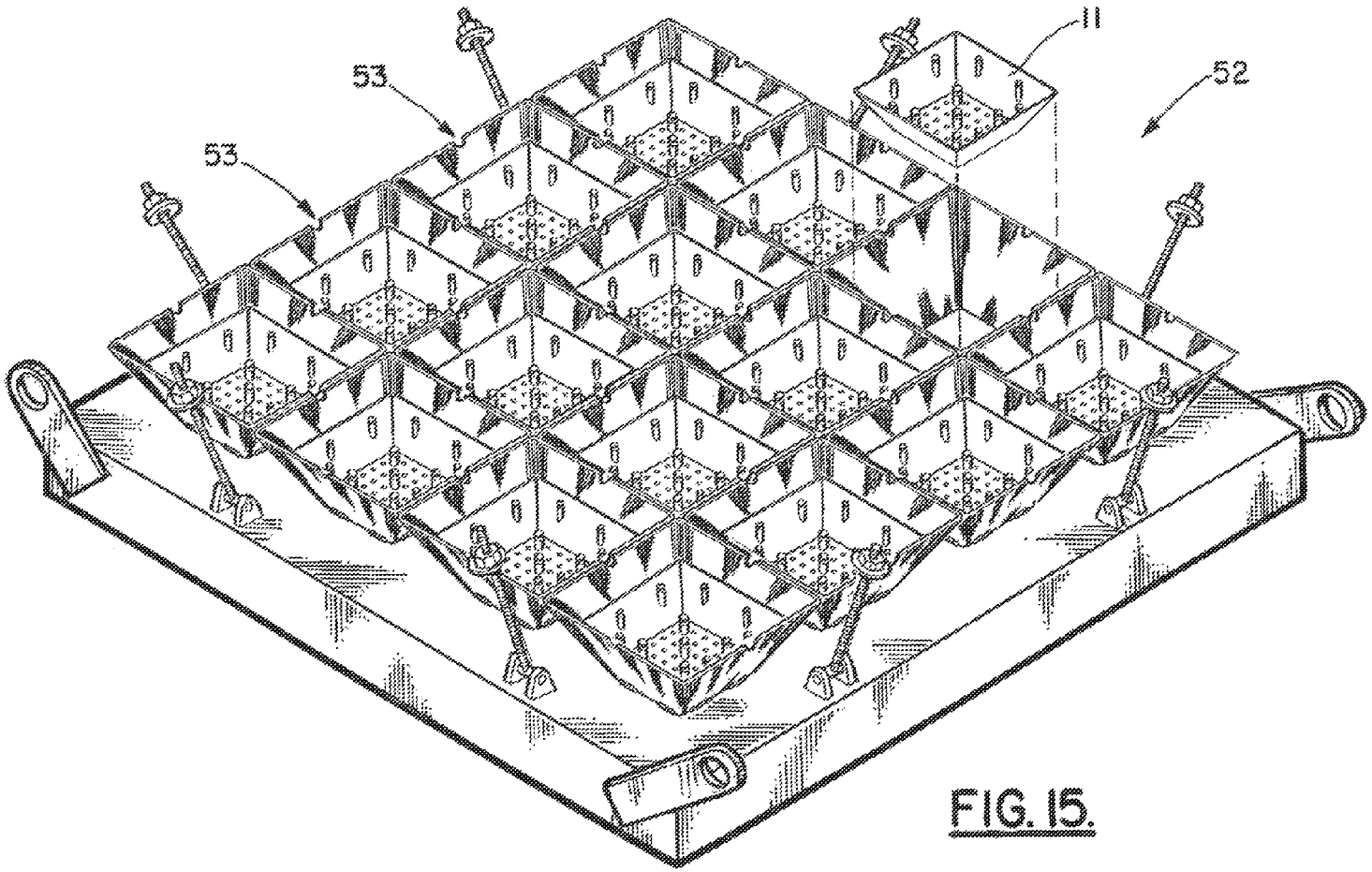
FIG. 15 is a fragmentary perspective view of a preferred embodiment of the apparatus of the present invention showing the mould.

FIGS. 10-13 show an additional embodiment of the apparatus of the present invention in the form of an alternate boot or pad, designated by the numeral 104. Boot or pad 104 can be used in place of the boot 11, in conjunction with boot 11 to have both top and bottom surfaces of a non-abrasive nature, or the boot or pad 104 can be used on both top and bottom to provide non-abrasive surfaces on both sides. Boot or pad 104 is similar to boot 11 but does not have the inclined side walls of boot 11. Boot or pad 104 can be about 8¾" (22.2 cm) long and about 8¾" (22.2 cm) wide. Boot or pad 104 has a panel 105 with upper surface 106 and lower surface 107. Lower surface 107 can be about 8½" (21.6 cm) long and about 8½" (21.6 cm) wide. Panel 105 can has a border portion 119 and base portion 120 (see FIG. 12). Border portion 119 can be about ⅛" (0.3 cm) thick. Base portion 120 can be about ⅛" (0.3 cm) thick. Boot or pad 104 has a periphery 108 that includes edges 109-112. Each edge 109-112 has a beveled or inclined surface. Edge 109 has beveled or inclined surface 113. Edge 110 has beveled or inclined surface 114. Edge 111 has beveled or inclined surface 115. Edge 112 has beveled or inclined surface 116. Surface 106 has a plurality (e.g. five (5) as shown in FIG. 10) of posts or anchors 16. The posts or anchors 16 can thus be configured as shown in FIG. 7. In FIG.

10-13, the four posts or anchors 16 that are located near the edges of the panel 105 can each be located about 2⅜" (6.0 cm) from the edges of panel 105. Posts or anchors 16 can extend about 1⅜" (3.5 cm) from the lower surface 107 of panel 105. Lower surface 107 has rows 117 and columns 118 of projections 13 (e.g. six (6) projections 13 in each row 117 and six (6) projections 13 in each column 118). Projections 13 can be located about 1" (2.5 cm) apart from each other on panel 105. The projections 13 located closest to the edges of panel 105 can be located about 1¾" (4.4 cm) from the edge of lower surface 107. Projections 13 can extend about ¼" (0.6 cm) from the under surface of panel 105. As with the preferred embodiment and boot 11, the boot or pad 104 is a liner that is placed in the mould 50 lower half 52. Boot or pad 104 then becomes a covering, coating or boot for a lower part of the block 43 after the concrete or cementitious filler material hardens or sets. Optionally, boot 104 can be placed in the mould 50 upper half 51 and the lower half 52. Optionally, boot 104 can be placed in the mould 50 upper half 51 when boot 11 is placed in the lower half 52.

FIG. 22-25 show an additional embodiment of the apparatus of the present invention in the form of another alternate boot or pad, designated by the numeral 130. Boot or pad 130 can be used in place of the boot 11 or pad 104, in conjunction with boot 11 to have both top and bottom surfaces of a non-abrasive nature, or the boot or pad 130 can be used on both top and bottom to provide non-abrasive surfaces on both sides. Boot or pad 130 is similar to boot 11 but does not have the inclined side walls of boot 11. Boot or pad 130 can be about 6¼" (15.9 cm) long and about 6¼" (15.9 cm) wide. Boot or pad 130 has a panel 131 with upper surface 132 and lower surface 133. Lower surface 133 can be about 5¼" (13.3 cm) long and about 5¼" (13.3 cm) wide. Panel 131 can has a border portion 134 and base portion 135 (see FIG. 24). Border portion 134 can be about ¼" (0.6 cm) thick. Base portion 135 can be about ⅛" (0.3 cm) thick. Boot or pad 130 has a periphery 136 that includes edges 137-140. Each edge 137-140 has a beveled or inclined surface. Edge 137 has beveled or inclined surface 141. Edge 138 has beveled or inclined surface 142. Edge 139 has beveled or inclined surface 143. Edge 140 has beveled or inclined surface 144.

Figure 22:
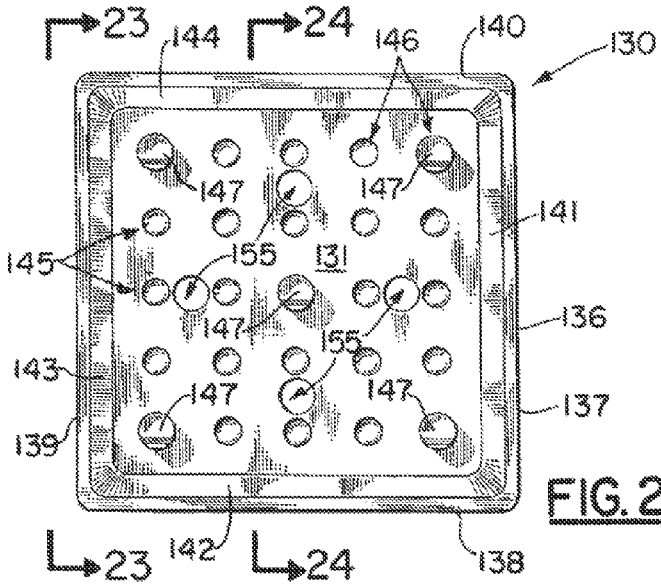
FIG. 22 is a top view of another alternate embodiment of the apparatus of the present invention.
Figure 23:
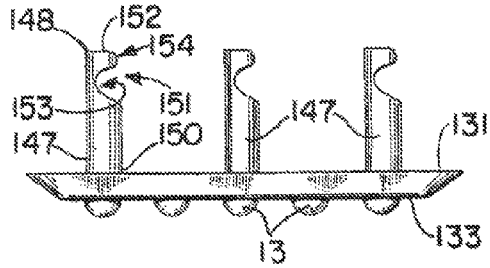
FIG. 23 is a side view of another alternate embodiment of the apparatus of the present invention taken along lines 23-23 of FIG. 22.
Figure 24:
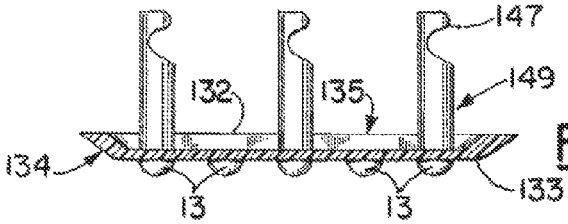
FIG. 24 is a side sectional view of another alternate embodiment of the apparatus of the present invention taken along lines 24-24 of FIG. 22.
Figure 25:
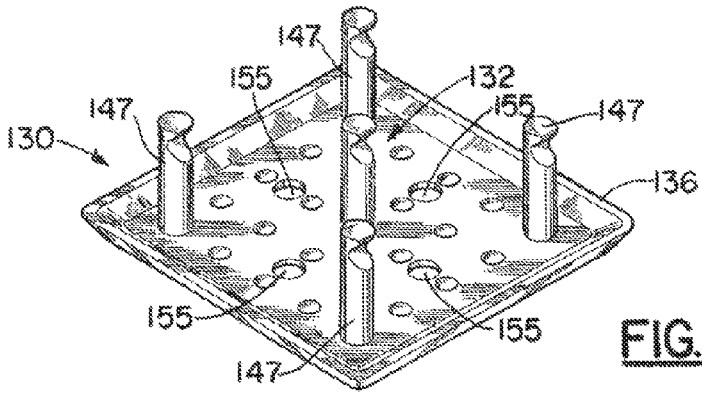
FIG. 25 is a perspective top view of another alternate embodiment of the apparatus of the present invention.

Surface 132 has a plurality (e.g. five (5) as shown in FIGS. 22, 25) of posts or anchors 147. Posts 147 have upper end portion 148 and lower end portion 150. The upper end portion 148 of each post 147 can provide recess or concavity 151, a projecting portion 152, and curved surfaces at 153 (having a radius of curvature of ⅜" (0.9 cm)), 154 (having a radius of curvature of ¼" (0.6 cm)). In FIG. 22-25, the four posts or anchors 147 that are located near the edges of the panel 131 can each be located about 1⅛" (2.9 cm) from the edges of panel 131. Posts or anchors 147 in FIGS. 22-25 can be about 1¾" (4.4 cm) long and about ½" (1.3 cm) wide. The upper end portion 148 of post 147 can be about 7/16" (1.1 cm) wide and the lower length 149 below recess 151 of post 147 can be about 1" (2.5 cm) long. Lower surface 133 has rows 145 and columns 146 of projections 13 (e.g. five (5) projections 13 in each row 145 and five (5) projections 13 in each column 146). Projections 13 can be located about 1" (2.5 cm) apart from each other on panel 131. The projections 13 located closest to the edges of lower surface 133 can be located about ⅝" (1.6 cm) from the edge of lower surface 133. Projections 13 can extend about ¼" (0.6 cm) from the under surface of panel 131. Panel 131 has a plurality (e.g., four (4) as shown in FIGS. 22 and 25) of holes 155. Holes 155 extend through panel 131 from upper surface 132 to lower surface 133 of pad 130. As with the preferred embodiment and boot 11, the boot or pad 130 is a liner that is placed in the mould 50 lower half 52. Boot or pad 130 then becomes a covering, coating or boot for a lower part of the block 43 after the concrete or cementitious filler material hardens or sets. Optionally, pad 130 can be placed in the mould 50 upper half 51 and the lower half 52. Optionally, pad 130 can be placed in the mould 50 upper half 51 when boot 11 is placed in the lower half 52.

The following is a list of parts and materials suitable for use in the present invention:

PARTS LIST

| PART NUMBER | DESCRIPTION |
|---|---|
| 10 | mat apparatus |
| 11 | boot |
| 12 | panel/bottom wall |
| 13 | projection/hemispherical projection |
| 14 | row of projections |
| 15 | column of projections |
| 16 | post/anchor |
| 17 | cylindrical side wall |
| 18 | recess/concavity |
| 19 | projecting surface |
| 20 | curved surface |
| 21 | curved surface |
| 22 | end portion |
| 23 | end portion |
| 24 | inclined side wall/panel |
| 25 | inclined side wall/panel |
| 26 | inclined side wall/panel |
| 27 | inclined side wall/panel |
| 28 | post/anchor |
| 29 | cylindrical side wall |
| 30 | recess/concavity |
| 31 | projecting position |
| 32 | curved surface |
| 33 | curved surface |
| 34 | end portion |
| 35 | end portion |
| 36 | diagonal/inclined surface |
| 37 | edge |
| 38 | edge |
| 39 | edge |
| 40 | edge |
| 41 | boot cavity |
| 42 | cable/rope/copolymer rope |
| 43 | block |
| 44 | periphery |
| 45 | upper block section |
| 46 | lower block section |
| 50 | mould |
| 51 | mould half |
| 52 | mould half |
| 53 | rope opening |
| 54 | upper opening/concrete inlet |
| 55 | padeye |
| 56 | multiple cavity mould assembly |
| 57 | connecting members |
| 58 | mould cavity |
| 59 | concavity |
| 60 | boot |
| 61 | panel/bottom wall |
| 62 | projection/hemispherical projection |
| 63 | row of projections |
| 64 | column of projections |
| 73 | inclined side wall/panel |
| 74 | inclined side wall/panel |
| 75 | inclined side wall/panel |
| 76 | inclined side wall/panel |
| 86 | edge |
| 87 | edge |
| 88 | edge |
| 89 | edge |
| 90 | boot cavity |
| 91 | inwardly projecting lip |
| 92 | inwardly projecting lip |
| 93 | inwardly projecting lip |
| 94 | inwardly projecting lip |
| 95 | corner |

-continued

| PARTS LIST | |
|---|---|
| PART NUMBER | DESCRIPTION |
| 96 | corner |
| 97 | corner |
| 98 | corner |
| 99 | curved side wall |
| 100 | recess/concavity/corrugation |
| 101 | recess/concavity/corrugation |
| 102 | larger upper end of recess |
| 103 | smaller upper end of recess |
| 104 | boot/pad |
| 105 | panel |
| 106 | upper surface |
| 107 | lower surface |
| 108 | periphery |
| 109 | edge |
| 110 | edge |
| 111 | edge |
| 112 | edge |
| 113 | beveled/inclined surface |
| 114 | beveled/inclined surface |
| 115 | beveled/inclined surface |
| 116 | beveled/inclined surface |
| 117 | row of projections |
| 118 | column of projections |
| 119 | border portion |
| 120 | base portion |
| 130 | boot/pad |
| 131 | panel |
| 132 | upper surface |
| 133 | lower surface |
| 134 | border portion |
| 135 | base portion |
| 136 | periphery |
| 137 | edge |
| 138 | edge |
| 139 | edge |
| 140 | edge |
| 141 | beveled/inclined surface |
| 142 | beveled/inclined surface |
| 143 | beveled/inclined surface |
| 144 | beveled/inclined surface |
| 145 | row of projections |
| 146 | column of projections |
| 147 | post/anchor |
| 148 | upper end portion |
| 149 | post lower length |
| 150 | lower end portion |
| 151 | recess/concavity |
| 152 | projecting portion |
| 153 | curved surface |
| 154 | curved surface |
| 155 | hole |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An erosion control mat, comprising:

a) a plurality of concrete blocks, each block having an upper portion with a plurality of upper inclined side walls, a plurality of corners, a lower portion with a plurality of inclined lower side walls, a block upper surface, a block lower surface and a block periphery in the form of a block edge where the upper and lower side walls meet;

b) one or more cables or ropes that connect said blocks together to form a block matrix;

c) each block having a boot affixed to the block lower portion, said boot having a plurality of inclined side panels, each side panel having an upper edge, the boot having a lower panel, a boot interior surface, and an interior that is receptive of at least part of the block lower portion;

d) wherein the boot inclined side panels engage the block inclined lower side walls and the boot lower panel engaging the block lower surface;

e) a plurality of anchor posts attached to the interior surface of the boot, some of the anchor posts attached to the side wall panels to enable a connection to be formed between the boot inclined side panels and the block inclined lower side walls;

f) wherein some of the anchor posts are attached to the lower panel to enable a connection to be formed between the boot lower panel and the block lower surface; and g) corrugations at one or more of said corners.

2. The erosion control mat of claim 1 wherein a plurality of said anchor posts having central longitudinal axes that are parallel.

3. The erosion control mat of claim 1 wherein the boot lower panel has a plurality of projections.

4. The erosion control mat of claim 3 wherein the projections are hemispherically shaped.

5. The erosion control mat of claim 3 wherein there is a concavity in the interior surface of the boot bottom panel at each projection.

6. The erosion control mat of claim 1 wherein said matrix is comprised of a plurality of block rows and a plurality of block columns, each of said rows retained together by said cables or ropes so that the rows are generally parallel.

7. The erosion control mat of claim 1 wherein said matrix is comprised of a plurality of block rows and a plurality of block columns, each of said columns retained together by said cables or ropes so that the rows are generally parallel.

8. The erosion control mat of claim 1 wherein at least some of the boot side panels have a pair of said anchor posts.

9. The erosion control mat of claim 1 wherein each boot side panel has a pair of said anchor posts.

10. The erosion control mat of claim 1 wherein said posts do not extend beyond said upper edges.

11. The erosion control mat of claim 1 wherein said boot side panel upper edges do not extend above the block edge.

12. The mat of claim 1 wherein the boot upper edges are positioned below the cables or ropes.

13. A method of constructing an erosion control mat, comprising the steps of:

a) providing a mould apparatus that is comprised of a plurality of moulds;

b) placing a boot in each mould, said boot having a plurality boot anchor posts, a plurality of inclined side panels, a plurality of corners, each side panel having an upper edge, the boot having a lower panel, a boot interior surface, and a boot interior that is receptive of slurried concrete that can be added to the boot interior;

c) filling each mould including the boot with slurried concrete that sets after a time period to form a plurality of concrete blocks, each block having an upper portion with a plurality of inclined upper side walls, a lower portion with a plurality of inclined lower side walls, a block upper surface, a block lower surface and a block periphery in the form of a block edge where the upper and lower block side walls meet the boot defining a lower portion of the block;

d) before said time period expires, placing one or more cables or ropes into the moulds so that after the said time period expires, the cable or rope or cables or ropes connect said blocks together to form a block matrix;

e) forming a connection of the boot to the slurried concrete before the said time period expires with a plurality of said anchor posts extending from said boot to said slurried concrete;

f) wherein in steps "b" and "e", said plurality of anchor posts are attached to the interior surface of the boot, some of the anchor posts attached to the side wall panels to enable a connection to be formed between the boot inclined side panels and the block inclined lower side walls;

g) wherein in steps "b" and "e" some of the anchor posts are attached to the lower panel to enable a connection to be formed between the boot lower panel and the block lower surface.

14. The method of claim 13 wherein in step "b" the boot lower panel has a plurality of projections.

15. The method of claim 14 wherein there is a concavity in the interior surface of the boot bottom panel at each projection and in step "c" the slurried concrete fills each said concavity.

16. The method of claim 13 further comprising placing some of said anchor posts parallel to other of said anchor posts.

17. The method of claim 13 wherein the boot in step "b" does not extend above the block lower inclined side walls.

18. The method of claim 13 wherein step "b" include providing multiple anchor posts on the boot side panels and multiple anchor posts on the boot lower panel.

19. The method of claim 18 wherein step "b" includes providing multiple anchor posts on each boot inclined side panel.

20. The method of claim 13 wherein in step "b" the anchor posts only connect with the block lower portion.

* * * * *